United States Patent [19]

Sato et al.

[11] Patent Number: 4,864,797

[45] Date of Patent: Sep. 12, 1989

[54] CONCRETE FILLED TUBE COLUMN AND METHOD OF CONSTRUCTING SAME

[75] Inventors: Takanori Sato; Yasushi Watanabe; Yasukazu Nakamura; Yutaka Saito, all of Tokyo, Japan

[73] Assignee: Shumizu Construction Co., Ltd., Tokyo, Japan

[21] Appl. No.: 207,163

[22] Filed: Jun. 15, 1988

[30] Foreign Application Priority Data

Apr. 1, 1988 [JP] Japan ..... 63-80444

[51] Int. Cl.[4] ..... E04C 3/34

[52] U.S. Cl. ..... 52/725; 52/721; 264/256; 264/262

[58] Field of Search ..... 52/725, 721, 252; 264/35, 256, 262

[56] References Cited

U.S. PATENT DOCUMENTS

| | | |
|---|---|---|
| 836,673 | 11/1906 | Ford . |
| 1,190,002 | 7/1916 | Picuri . |
| 1,432,192 | 10/1922 | Lally . |
| 1,571,091 | 1/1926 | Lally . |
| 1,571,092 | 6/1926 | Lally . |
| 2,176,007 | 10/1939 | Heanue . |
| 2,698,519 | 1/1955 | Lloyd . |
| 3,058,264 | 10/1962 | Varlonga . |
| 3,382,680 | 5/1968 | Takano . |
| 3,793,794 | 2/1974 | Archer et al. . |
| 3,828,504 | 8/1974 | Egerborg et al. . |
| 3,963,056 | 6/1976 | Shibuya . |
| 3,991,532 | 11/1976 | Buxbom . |
| 4,016,701 | 4/1977 | Beynon . |
| 4,018,055 | 4/1977 | LeClereq . |
| 4,166,347 | 9/1979 | Pohlman et al. . |
| 4,281,487 | 8/1981 | Koller . |
| 4,470,106 | 9/1984 | Norton . |
| 4,694,622 | 9/1987 | Richard . |
| 4,722,156 | 2/1988 | Sato ..... 52/725 X |
| 4,783,940 | 11/1988 | Sato et al. ..... 52/725 X |

FOREIGN PATENT DOCUMENTS

| | | |
|---|---|---|
| 2723534 | 12/1976 | Fed. Rep. of Germany . |
| 1540495 | 8/1968 | France . |

*Primary Examiner*—Carl D. Friedman

*Attorney, Agent, or Firm*—Scully, Scott, Murphy & Presser

[57] ABSTRACT

A concrete filled tube column includes: an outer tube connected to beams of the structure, the outer tube consisting of a plurality of tube pieces coaxially disposed in series; a concrete core disposed within the outer tube; an inner flange peripherally mounted on the inner face of each tube piece; and a concrete layer peripherally disposed on the inner face of each tube piece. The concrete layer includes a tubular portion positioned under the inner flange and in direct contact with the entire lower side of the inner flange. The tubular portion has an inner peripheral face tapering upward so that the transverse inner size at the lower end of the tubular portion is equal to the transverse inner size of each tube piece. In constructing the column, a plurality of the precast structural tubes, each including: the tube piece; the inner flange; and the concrete layer, are prepared. Then, one of the precast tubes is erected. Concrete is placed within the erected precast tube to form a concrete core. The beams of the structure are connected to the erected precast structural tube. Another precast tube is coaxially connected to the upper end of the erected precast tube, whereby said another precast tube is erected on the lower adjoining structural tube. Thereafter, the steps from the concrete-placing step to the tube-connecting step are repeated a plurality of times.

33 Claims, 9 Drawing Sheets

CONCRETE FILLED TUBE COLUMN AND METHOD OF CONSTRUCTING SAME

BACKGROUND OF THE INVENTION

This invention relates to a concrete filled tube column and a method of constructing the same, the concrete filled tube column constituting, for example, a part of a building structure, such as a column and a pile.

FIGS. 1 to 3 show an example of a conventional concrete filled tube column constituting a part of a building structure. This column 20 is made of a steel outer tube 22 within which concrete is filled to form a concrete core 24. The outer tube 22 includes a plurality of tube bodies 26, and a plurality of joint tubes 28. Each joint tube 28 coaxially interconnects two adjoining tube bodies 26. The beams 30 of the building structure are welded to the outer face of each joint tube 28 so that an axial load is transmitted from the beams 30 to the outer tube 22. Furthermore, a pair of vertically spaced parallel inner flanges 32 are circumferentially welded on the inner face of each joint tube 28, and project radially inward into the concrete core 24 to transmit the axial load from the outer tube 22 to the core 24. In this column, the axial compressive strength of the concrete core 24 is enhanced by the lateral confinement of the outer tube 22, and thereby it is possible to considerably reduce the cross-sectional area of the column in comparison with the cross-sectional area of a conventional concrete column without an outer tube.

However, upon the construction of the above-described column, there arises an inconvenience that air spaces and rock pockets tend to be generated in the concrete core 24 because of the inner flanges 32. For example, when concrete is charged into an erected outer tube 22 to form the concrete core 24, the inner flanges 32 become obstacles to air smoothly flowing upward and discharging from the outer tube 22, resulting in the air spaces 34 (see FIG. 3) confined between the charged concrete and the lower surfaces of the inner flanges 32. In addition to the above example, during the curing of the charged concrete, the inner flanges 32 also become obstacles to the setting of the concrete, i.e., the downward movement of the concrete due to the contraction of the concrete. This fact also results in the air spaces 34 generated under the inner flanges 32. These air spaces 34 not only prevent the inner flanges 32 from transmitting the axial load from the outer tube 22 to the core 24 but also reduce the axial compressive strength of the concrete core 24. Furthermore, upon the setting of the concrete, since the concrete paste contained in the concrete flows downward more smoothly than the aggregates contained in the concrete, the aggregates tend to gather around the inner flanges 32 and form the rock pockets 36 (see FIG. 3) in the concrete core 24. These rock pockets 36 also reduces the axial compressive strength of the concrete core 24.

In order to avoid the generation of the air spaces and the rock pockets, the charging of the concrete may be stopped every time the concrete is filled in the outer tube 22 up to the level of one of the inner flanges 32. After the charged concrete is hardened, concrete charging may be resumed until the concrete is filled up to the next inner flange 32. However, such a process of concrete charging considerably lengthen the construction period of the column 20.

SUMMARY OF THE INVENTION

Accordingly, it is an object of the present invention to provide a concrete filled tube column in which air spaces and rock pockets are not generated.

Another object of the present invention is to provide a method of constructing the concrete filled tube column which prevents the concrete core from developing either air spaces or rock pockets without lengthening the construction period.

Still another object of the present invention is to provide a method of constructing the concrete filled tube column which reliably maintains the compressive strength of the column.

A further object of the present invention is to provide a precast structural tube for use in the concrete filled tube column, which prevents the concrete core from developing either air spaces or rock pockets.

With these and other objects in view, an aspect of the present invention is directed to a concrete filled tube column which includes: an outer tube connected to beams of the structure so that an axial load is transferred from the beams and applied to the outer tube, the outer tube consisting of a plurality of tube pieces coaxially disposed in series, the tube pieces having substantially equal transverse inner sizes; a concrete core disposed within the outer tube; a first inner flange, peripherally mounted on the inner face of each of the tube pieces and projecting radially inward, for transferring the axial load from the outer tube to the concrete core; and a concrete layer peripherally disposed on the inner face of each of the tube pieces. The concrete layer includes a first tubular portion concentric with each of the tube pieces. The first tubular portion is positioned under the first inner flange in such a manner that the first tubular portion is in direct contact with the entire lower side of the first inner flange. The first tubular portion has a first inner peripheral face tapering upward so that the transverse inner size at the lower end of the first tubular portion is equal to the transverse inner size of each of the tube pieces. When concrete is charged into the outer tube, the tapering inner peripheral face allows air thereunder to flow upward smoothly therealong, thus preventing the generation of the air spaces under the tubular member. Also, during the setting of the charged concrete, the tapering inner peripheral face enables the concrete to smoothly move therealong and to come into the space directly under the tubular member. As a result, generation of air spaces r rock pockets are prevented.

Another aspect of the present invention is directed to a precast structural tube for use in the concrete filled tube column. The precast structural tube includes: a tube piece having first and second ends; a radially inwardly projecting first inner flange mounted on the inner face of the tube piece, the first side being closer to the first end of the tube piece than the second side; and a concrete layer peripherally disposed on the inner face of the tube piece. The concrete layer includes a first tubular portion concentric with the tube piece. The first tubular portion has a first inner peripheral face. One of the opposite ends of the first tubular portion is in direct contact with the entire first side of the first inner flange. The first inner peripheral face of the first tubular portion tapers toward the second end of the tube piece so that the transverse inner size at the other end of the first tubular portion is equal to the transverse inner size of the tube pieces.

Still another aspect of the present invention is directed to a method of constructing a concrete filled tube column. A plurality of the precast structural tubes are prepared. Then, one of the prepared precast structural tubes is erected with the second end of the tube piece positioned above the first end of the tube piece. Concrete is placed within the erected precast structural tube to form a concrete core within the structural tube. The beams of the structure are connected to the erected precast structural tube. Another precast structural tube is coaxially connected to the upper end of the erected precast structural tube, whereby said another structural tube is erected on the lower adjoining structural tube. Thereafter, the above-mentioned steps from the concrete-placing step to the tube-connecting step are repeated a plurality of times.

DETAILED DESCRIPTION OF THE PREFERRED EMBODIMENTS

Figure 1:
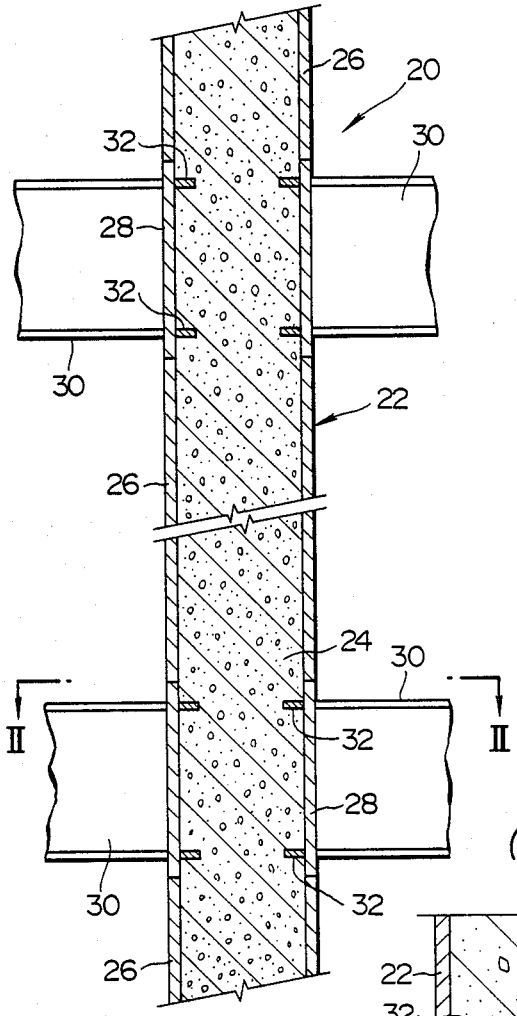
FIG. 1 (PRIOR ART)
FIG. 1 is a fragmentary axial-sectional view of a conventional concrete filled tube column.
Figure 2:
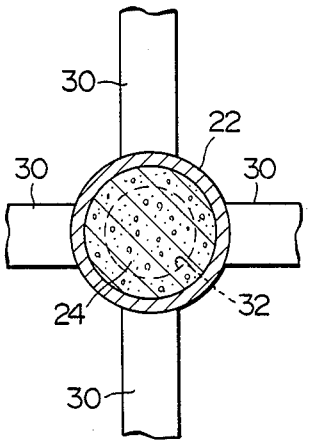
FIG. 2 (PRIOR ART)
FIG. 2 is a view taken along the line II—II in FIG. 1.
Figure 3:
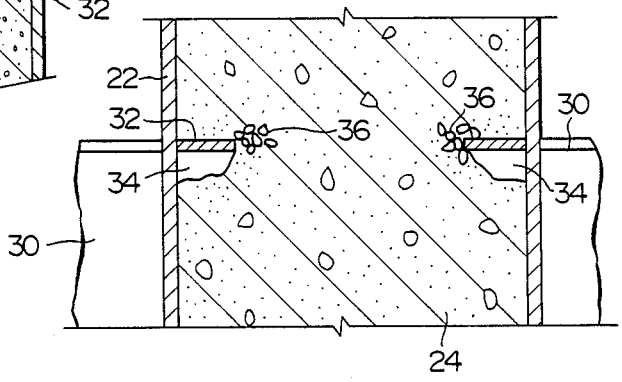
FIG. 3 (PRIOR ART)
FIG. 3 is an enlarged axial-sectional view of the conventional column in FIG. 1.

Referring now to FIGS. 4 to 17, wherein like reference characters designate corresponding parts throughout several views, and descriptions of the corresponding parts are omitted after once given.

Figure 4:
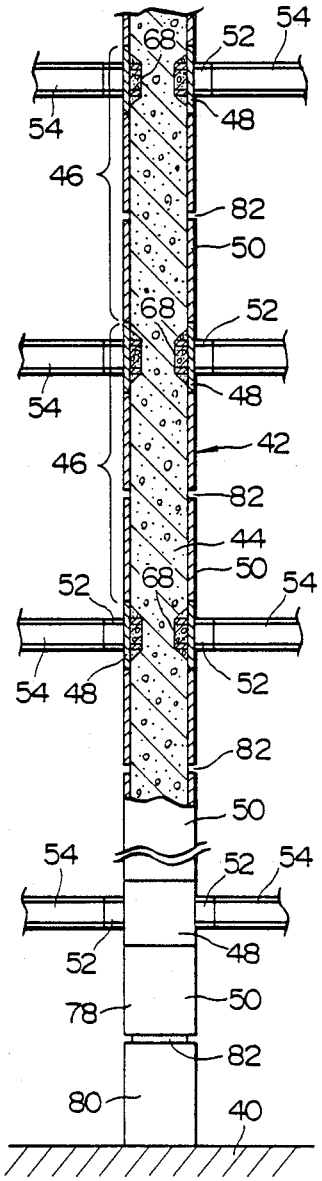
FIG.4 is a fragmentary front view partly in section, of a concrete filled tube column according to the present invention.

FIG. 4 shows a concrete filled tube column according to the present invention, which is erected on a foundation 40 and constitutes a part of a building structure. This column has an outer tube 42 in which concrete is filled to form a concrete core 44. The outer tube 42 consists of a plurality of round steel tube pieces 46 coaxially joined in series. Each of the tube pieces 46 includes a joint tube 48 and a tube piece body 50 which is coaxially joined to the lower end of the joint tube 48. A plurality of bracket members in the form of H-steel bars 52 are welded to the outer face of the joint tube 48 so as to project radially outward from the outer face, and interconnect the joint tube 48 with beams 54 of the building structure. Each H-steel bar 52 consists of upper and lower flange portions 56 and 58 and a web portion 60 interconnecting the upper and lower flange portions 56 and 58 (see FIG. 5). A pair of vertically spaced parallel inner flanges 64 and 66 are circumferentially welded to the inner face of the joint tube 48 in order to transfer the axial load from the joint tube 48 to the core 44. Each of the inner flanges 64 and 66 is of a disk-like configuration having a central aperture and protrudes radially inward from the inner face of the joint tube 48. The upper inner flange 64 is positioned at the same level as the upper flange portions 56 of the bracket members 52, while the lower inner flange 66 is positioned at the same level as the lower flange portions 58 of the bracket members 52. Furthermore, a concrete layer 68 made of a high strength concrete is circumferentially disposed on the inner face of the joint tube 48.

Figure 5:
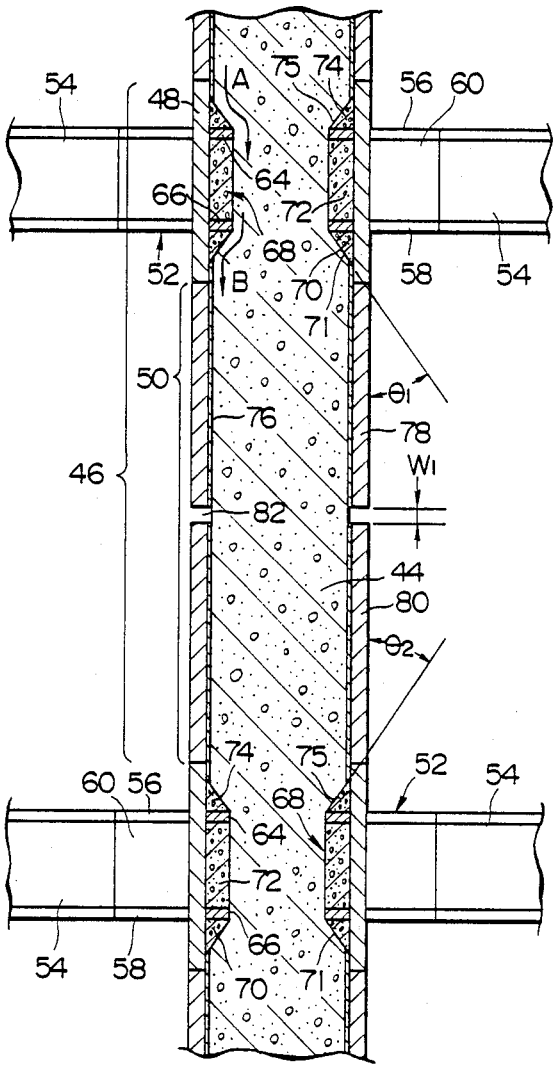
FIG. 5 is an enlarged axial-sectional view of the column in FIG

As best shown in FIG. 5, the concrete layer 68 consists of three cylindrical portions, namely, first, second and third portions 70, 72 and 74 which are coaxial with the joint tube 48. The first portion 70 is positioned under the lower inner flange 66 in such a manner that the upper end of the first portion 70 is in direct contact with the entire lower side of the first inner flange 66. This first portion 70 has an inner peripheral face 71 tapering upward so that the inner diameter at the upper end of the first portion 70 is generally equal to the inner diameter of the lower inner flange 66 and the inner diameter at the lower end of the first portion 70 is generally equal to the inner diameter of the joint tube 48. The tapering angle 01 of the inner peripheral face 71 with respect to the axis of the joint tube 48 is, preferably, in the range of 45° to 60°. The second portion 72 extends between the upper and lower inner flanges 64 and 66. This second portion 72 has an inner diameter generally equal to the inner diameters of the upper and lower inner flanges 64 and 66. The third portion 74 is positioned above the upper inner flange 64 in such a manner that the lower end of the third portion 74 is in direct contact with the entire upper side of the upper inner flange 64. This third portion 74 has an inner peripheral face 75 tapering downward so that the inner diameter at the lower end of the third portion 74 is generally equal to the inner diameter of the upper inner flange 64 and the inner diameter at the upper end of the third portion 74 is generally equal to the inner diameter of the joint tube 48. The tapering angle 02 of the inner peripheral face 75 with respect to the axis of the joint tube 48 is, preferably, in the range of 45° to 60°. In addition, the high strength concrete forming the concrete layer 68 has a compressive strength higher than the compressive strength of the concrete which forms the concrete core 44.

As further shown in FIG. 5, a separating layer 76 is interposed between the concrete core 44 and the inner face of each tube piece 46 so that the core 44 is not bonded to the inner face of each tube piece 46. This separating layer 76 is made of a material such as asphalt, oil, grease, paraffin wax, petrolatum, synthetic resin and paper. The thickness of the separating layer 76 is such that it provides a viscous slip to the concrete core 44. In asphalt, the thickness is about 20 to 100 μm. Furthermore, the tube piece body 50 consists of upper and lower tubular sections 78 and 80. These upper and lower sections 78 and 80 are axially spaced apart from each other so that axial stress reducing means in the form of a ring-shaped gap 82 is formed between the upper and lower sections 78 and 80. The length of each of the upper and lower sections 78 and 80 is such that the gap 82 is positioned at the intermediate portion, that is, the inflection point of moment of the tube piece body 50. Since the separating layer 76 allows axial movement of each tube piece 46 relative to the core 44, the gap 82 varies its axial width $W_1$ when each tube piece 46 is subjected to the axial load which is transmitted from the beams 54 of the building structure. Accordingly, an axial stress which develops in each tube piece 46 is reduced by the gap 82. The concrete core 44 is subjected to considerably more axial stress than the tube pieces 46 since the axial load applied to each tube piece 46 is transmitted to the core 44 via the upper and lower inner flanges 64 and 66 and the concrete layer 68. However, the outer tube 42 which is under considerably less stress than the core 44 provides the core 44 with sufficient lateral confinement, thereby effectively enhancing the axial compressive strength of the column.

Figure 6:
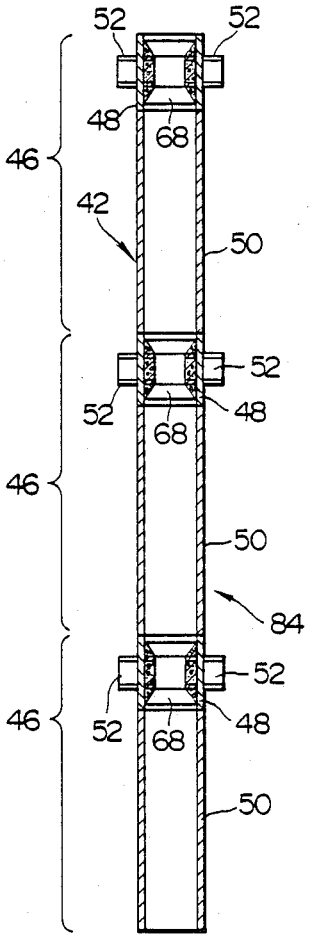
FIG. 6 is an axial-sectional view of a precast structural tube used for constructing the column in FIG. 4.
Figure 7:
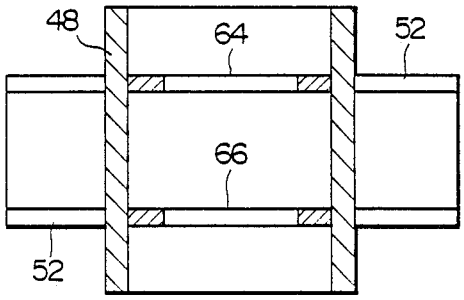
FIG. 7 is an enlarged axial-sectional view of a joint tube to which inner flanges and bracket members are welded.
Figure 8:
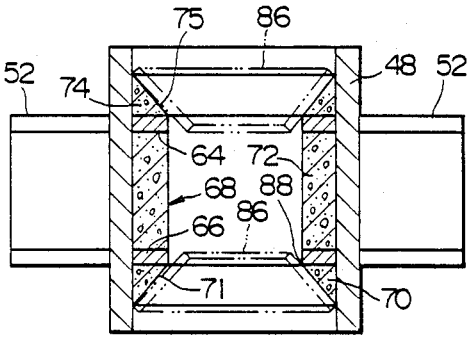
FIG. 8 is an enlarged axial-sectional view of the joint tube with a concrete layer disposed on the inner face thereof.

FIGS. 6 to 9 show a process for constructing the concrete filled tube column in FIG. 4. At first, a plurality of precast structural tubes 84 are prepared in a factory. One of the precast structural tubes 84 is shown in FIG. 6. This structural tube 84 is manufactured in the following way: Three joint tubes 48 and three tube piece bodies 50 are prepared. Then, as shown in FIG. 7, the H-steel bars 52 are welded to the outer face of each of the prepared joint tubes 48, and the upper and lower inner flanges 64 and 66 are welded to the inner face of each of the prepared joint tubes 48. Thereafter, the concrete layer 68 is formed on the inner face of each joint tube 48 as shown in FIG. 8. This concrete layer 68 is formed by rotating the joint tube 48 slowly about its axis, and by manually spreading a high strength concrete on the inner face of the joint tube 48 so that the tapering inner peripheral faces 71 and 75 are formed respectively at the first and third portions 70 and 74 of the concrete layer 68. Before spreading the concrete, reinforcements may be provided along the inner face of the joint tube 48 to facilitate the application of the concrete. Instead of the concrete being spread, the concrete may be placed between the inner surface of the joint tube 48 and a cylindrical formwork which is detachably fixed to the inner face of the joint tube 48. Alternatively, the concrete layer 68 is formed by centrifugal molding. More specifically, a pair of hollow truncated conical frameworks 86 are detachably fixed to the inner face of the joint tube 48 as shown by a phantom line in FIG. 8. The joint tube 48 is laid on a rotation machine in such a manner that the axis of the joint tube 48 extends substantially horizontally, and then the joint tube 48 is rotated about its axis at a high speed. Subsequently, predetermined amount of high strength concrete is placed between the formworks 86. As a result, the concrete placed in the joint tube 48 is subjected to a centrifugal force due to the rotation of the tube piece 48, thereby being spread throughout the area between the frameworks 86 and forming the concrete layer 68. Upon the centrifugal molding, a clearance 88 may be formed between each framework 86 and the corresponding inner flange so that the concrete between the inner flanges 64 and 66 flows through the clearance 88 into the frameworks 86 during the rotation of the joint tube 48. In addition to the clearance 88, through holes (not shown) may be formed in the inner flanges 64 and 66 so as to allow the concrete to flow into the frameworks 86. After the concrete layer 68 is formed on each of the joint tubes 48, the separating material such as asphalt and grease are coated on that portion of the inner face of each joint tube 48 where the concrete layer 68 and the inner flanges 64 and 66 are not provided. The same separating material is also coated on the inner face of each tube piece body 50 to form the separating layer 76. After that, the three joint tubes 48 are concentrically welded respectively to the upper ends of the three tube piece bodies 50 to form three tube pieces 46. Thus prepared three tube pieces 46 are coaxially joined in series to form the precast structural tube 84. In the above-mentioned process for manufacturing the precast structural tube 84, since the concrete layer 68 is formed after the welding of the inner flanges 64 and 66 and the H-steel bars 52 to the joint tube 48, the concrete layer 68 is not subjected to the heat due to the welding, and thereby the deterioration of the concrete layer 68 is prevented.

Figure 9:
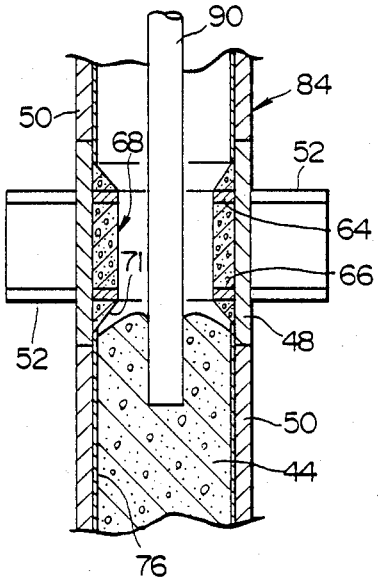
FIG. 9 is a fragmentary axial-sectional view of the precast structural tube which is being charged with concrete.

The precast structural tubes manufactured as mentioned above are transported from the factory to a construction site, and there, one of the precast structural tubes 84 is erected on the foundation 40. Subsequently, as shown in FIG. 9, concrete is charged into the erected precast structural tube 84 by using, for example, a tremie 90 (which is a concrete-supplying pipe for conveying concrete) to form the concrete core 44. As the top face of the concrete approaches the inner peripheral face 71 of the concrete layer 68, air around the tapering inner peripheral face 71 flows upward smoothly along the inner peripheral face 71, and therefore the space under the inner peripheral face 71 is completely filled with the charged concrete. During the subsequent curing process of the concrete, the concrete contracts and thereby moves downward smoothly along the inner peripheral faces 71 and 75 of the concrete layer 68 as indicated by arrows A and B in FIG. 5. Therefore, the concrete completely fills the space directly under the inner peripheral face 71 of the concrete layer 68. Consequently, no air spaces or rock pockets are generated under the inner peripheral faces 71 of the concrete layers 68 as well as under the inner flanges 64 and 66, resulting in the formation of the concrete core 44 having a reliable compressive strength. After the charged concrete is cured, each of the tube piece bodies 50 is separated into the upper and lower sections 78 and 80 by using a suitable cutter so that the gap 82 is formed between the upper and lower sections 78 and 80. The beams 54 of the building structure are joined respectively to the H-steel bars 52 of the precast structural tube 84, and then, another precast structural tube 84 is coaxially joined to the upper end of the concrete filled precast structural tube 84. Thereafter, the above-mentioned steps from the concrete-charging step to the precast tube-joining step are repeated predetermined times, which results in the construction of the concrete filled tube column.

Instead of the precast structural tube 84, a precast structural tube including less than or more than three tube pieces 46 may be used for constructing the concrete filled tube column. Also, instead of the second portion 72 of the concrete layer 68, another first portion 70 and another third portion 74 may be formed respectively under the upper inner flange 64 and above the lower inner flange 66. Furthermore, in place of the steel tube piece body 50, a tube piece body made of a carbon fiber reinforced concrete may be employed. This tube piece body consists of a hollow cylindrical cement matrix and a high strength carbon filament which is embedded within the cement matrix in such a manner that the carbon filament forms a coil coaxial with the cement matrix. Such a tube piece body is prepared by impregnating the carbon filament with a cement paste including cement particles of a particle size smaller than the diameter of the carbon filament and by forming the carbon filament into a cylindrical configuration. This fiber reinforced concrete tube piece body has a Young's modulus substantially equal to the Young's modulus of the concrete core 44, thereby providing the concrete core 44 with a sufficient lateral confinement even though neither the separating layer 76 nor stress reducing means 82 is disposed on the tube pieces.

Figure 10:
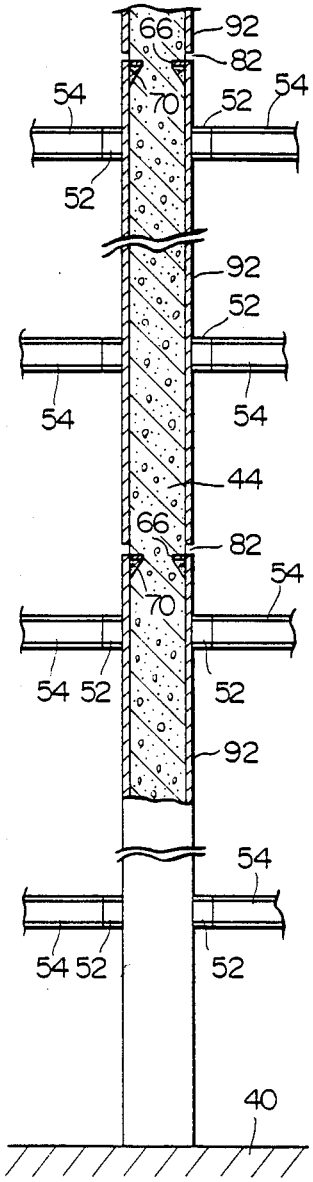
FIG. 10 is a front view, partly in section, of another embodiment of the present invention.
Figure 11:
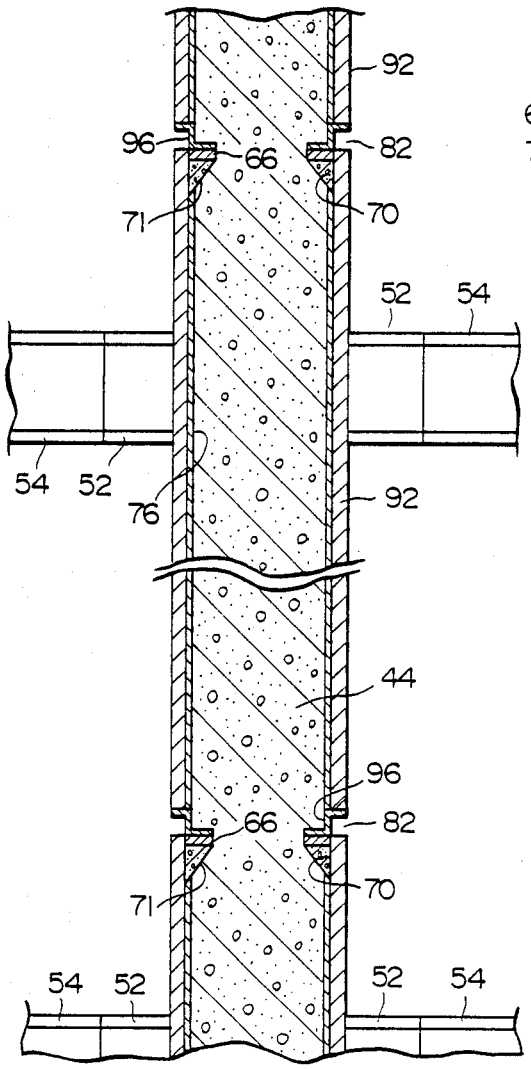
FIG. 11 is an enlarged fragmentary axial-sectional view of the concrete filled tube column in FIG. 10.
Figure 12:
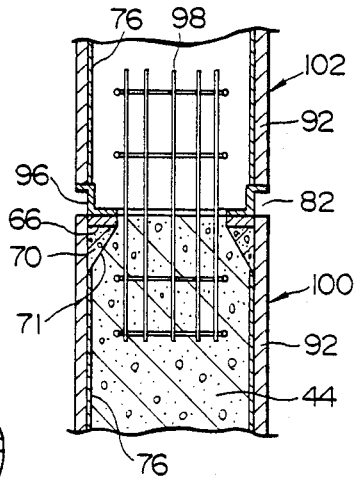
FIG. 12 is a fragmentary axial-sectional view of a joint portion between two precast structural tubes.

FIGS. 10 and 11 illustrate another embodiment of the present invention, in which tube pieces 92 are axially spaced apart from one another so that a ring-shaped gap 82 is formed between any two adjoining tube pieces 92. As best shown in FIG. 11, each of the tube pieces 92 has an inner flange 66 welded at the upper end thereof. A concrete layer 70 is disposed under the inner flange 66. A separating layer 76 is interposed between a concrete core 44 and that portion of the inner face of each tube piece 92 where the inner flange 66 an the concrete layer are not disposed. A plurality of bracket members 52 are welded to the outer face of each tube piece 92 and interconnecting the tube piece 92 with the beams 54 of the building structure. An essentially ring-shaped spacer 96 is interposed between each tube piece 92 and the adjoining tube piece 92 so that the gap 82 is sealed. This spacer 96 is made of a resilient material such as a rubber and synthetic resin, and is attached to the lower end of each tube piece 92 by an adhesive agent such as an epoxy resin and the like. This concrete filled tube column is constructed as follows: A plurality of precast structural tubes, each having the tube piece 92, the inner flange 66, the concrete layer 70, the bracket members 52, the separating layer 76 and the spacer 96, are manufactured in a factory. Thereafter, the manufactured precast tubes are transported to a construction site, and coaxially joined one by one in the same manner as described in the foregoing embodiment. In joining a precast structural tube to the upper end of a concrete filed precast tube, a reinforcing member 98 (see FIG. 12) of a cylindrical skeleton construction may be disposed inside the joint portion of the two precast tubes and so that the mechanical strength of the joint portion is enhanced. More specifically, as shown in FIG. 12, the lower half of the reinforcing member 98 is embedded in the concrete core 44 formed in the lower precast tube 100 so that the upper half of the reinforcing member 98 project upward from the upper end of the lower precast tube 100, and then the upper precast tube 102 is coaxially placed on the lower precast tube 100 so that the upper half of the reinforcing member 98 is inserted into the upper precast tube 102. After that, concrete is charged into the upper precast tube 102.

Figure 13:
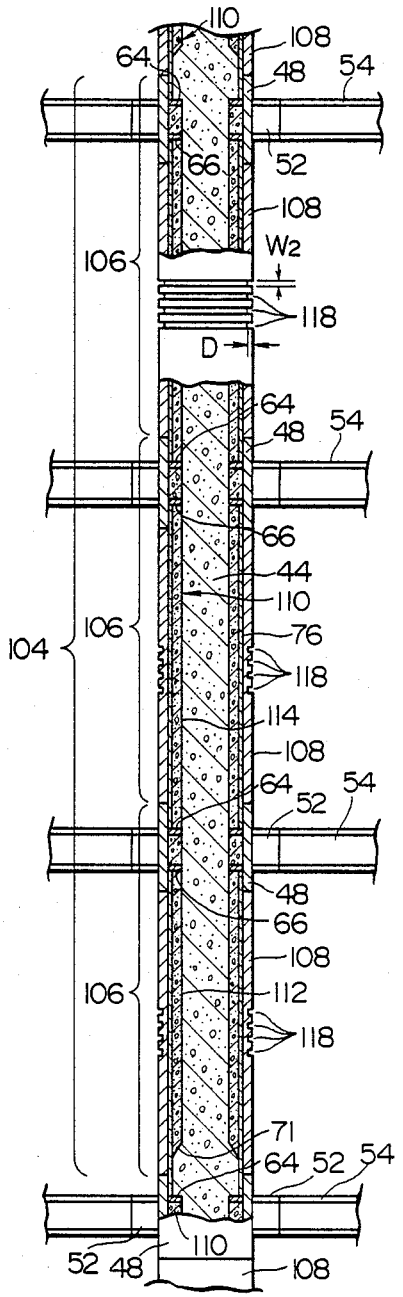
FIG. 13 is a front view, partly in section, of still another embodiment of the present invention.

Still another embodiment of the present invention is shown in FIG. 13, in which each of the tube pieces 104 consists of a plurality of tube elements 106 coaxially joined in series. Each of the tube elements 106 is constituted of a joint tube 48 and a steel tube element body 108 coaxially welded to the lower end of the joint tube 48. The joint tube 48 has a plurality of H-steel bars 52 and upper and lower inner flanges 64 and 66. The beams 54 of the building structure are connected to the joint tube 48 via the H-steel bars 52. The tube element body 108 has stress reducing means in the form of a plurality of circumferentially extending grooves 118 formed in its outer face. The number of the grooves 118 and the axial width $W_2$ and the radial depth D of each groove 118 are determined according to the design condition of the column. A separating layer 76 is coated on the entire inner face of the tube piece body 108 and the inner face of the joint tube 48 except for that portion of the inner face between the upper and lower inner flanges 64 and 66. Each of the tube piece 104 further has a concrete layer 110 which includes two cylindrical portions, namely, first and second portions 112 and 114, each being coaxial with the tube piece 104. The first portion 112 is positioned under the lower inner flange 66 of the lowermost tube element 106 in such a manner that the upper end of the first portion 112 is in direct contact with the entire lower side of the first inner flange 66 of the lowermost tube element 106. This first portion 112 has an inner peripheral face 71 tapering upward. The second portion 114 extends between the lower inner flange 66 of the lowermost tube element 106 and the upper inner flange 64 of the uppermost tube element 106. This second portion 114 has an inner diameter generally equal to the inner diameters of the upper and lower inner flanges 64 and 66. The upper end portion of the joint tube 48 of the uppermost tube element 106 and lower end portion of the lowermost tube element are not provided with the concrete layer 110.

Figure 14:
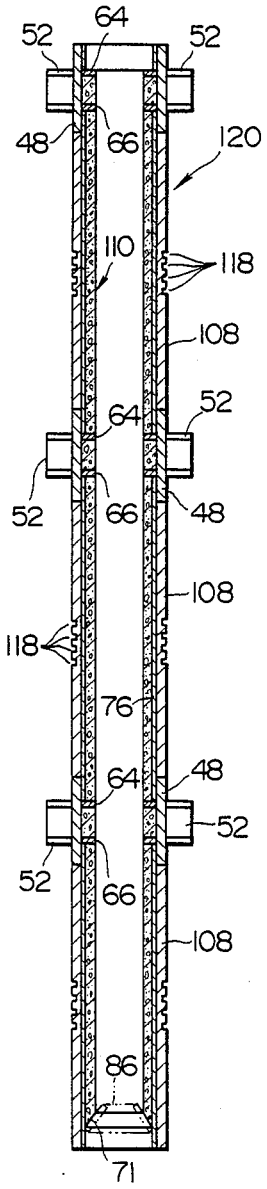
FIG. 14 is an axial-sectional view of a precast structural tube used for constructing the column in FIG. 3.
Figure 15:
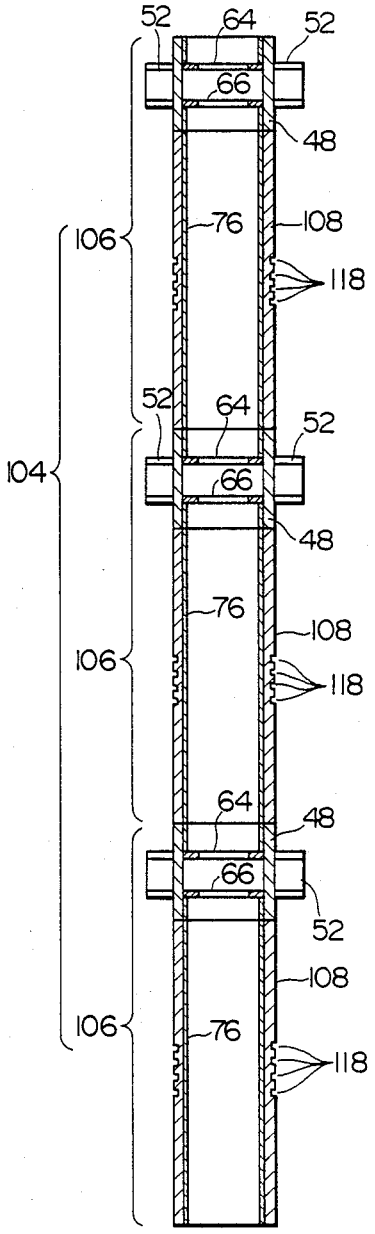
FIG. 15 is an axial-sectional view of a tube piece with a separating layer coated on the inner face thereof.
Figure 17:
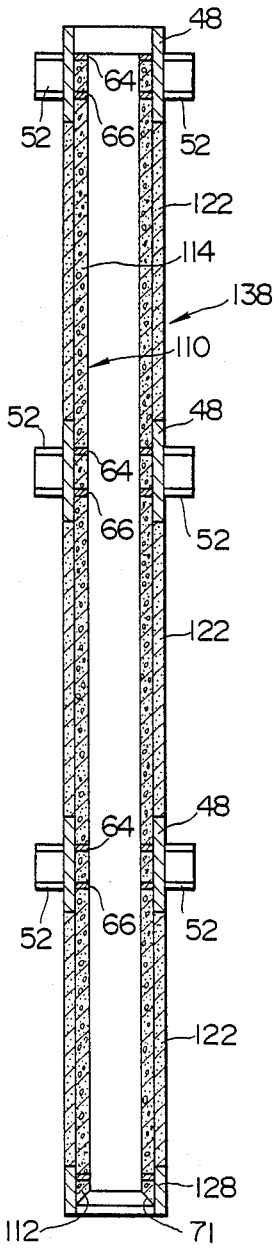
FIG. 17 is an axial-sectional view of a precast structural tube used for constructing the column in FIG. 16.

FIGS. 14 and 15 illustrate a process for constructing the concrete filled tube column shown in FIG. 13. At first, a plurality of precast structural tubes 120 are prepared in a factory. One of the precast structural tubes 120 is shown in FIG. 14. This precast structural tube 120 is manufactured as follows: A plurality of joint tubes 48 and a plurality of tube element bodies 108 are prepared. The H-steel bars 52 are welded to the outer face of each of the prepared joint tubes 48, while the upper and lower inner flanges 64 and 66 are welded to the inner face of each of the prepared joint tubes 48. The circumferential grooves 118 are formed at the intermediate portion of each of the prepared tube element bodies 108. The separating material is coated on the inner face of each joint tube 48 and on the inner face of each tube element body 108 to form a separating layer 76. After that, as shown in FIG. 15, the joint tubes 48 are concentrically welded the upper ends of the tube element bodies 108 respectively to form the tube elements 106, and thus prepared tube elements 106 are coaxially joined in series to form the tube piece 104. Then, the prepared tube piece 104 is provided with the concrete layer 110 by centrifugal molding. More specifically, a hollow truncated conical framework 86 is detachably fixed to the inner face of the lowermost tube element 106 as shown by a phantom line in FIG. 14. The tube piece 104 is laid on a rotation machine, and then the tube piece 104 is rotated about its axis at a high speed. Subsequently, predetermined amount of high strength concrete is placed between the formwork 86 and the upper inner flange 64 of the uppermost tube element 106. As a result, the concrete placed in the tube piece 104 forms the concrete layer 110 as shown in FIG. 14. In the above-mentioned process, since the concrete layer 110 is formed after the welding of the inner flanges 64 and 66 and the H-steel bars 52, the concrete layer 110 is not subjected to the heat due to the welding, and thereby the deterioration of the concrete layer 110 is prevented.

The precast structural tubes 120 manufactured as mentioned above are transported from the factory to a construction site, and there, they are coaxially joined one by one in the same manner as described in the first embodiment. In this embodiment, since the upper and lower inner flanges 64 and 66 between the upper inner flange 64 of the uppermost tube element 106 and lower inner flange 66 of the lowermost tube element 106 are embedded in the one concrete layer 110, it is not necessary to form tapering inner peripheral faces 71 under all the lower inner flanges 66. Therefore, the manufacturing efficiency of the precast structural tubes 120 is enhanced in comparison with that of the precast structural tube 84. Also, since the concrete layer 110 is disposed neither at the upper end portion of the joint tube 48 of the uppermost tube element 106 nor at the lower end portion of the lowermost tube element, the concrete layer 110 is not subjected to the heat due to the mutual welding of the precast structural tubes 120.

Above the upper inner flange 64 of the uppermost tube element 106, a third portion of the concrete layer may be formed in such a manner that the lower end of the third portion is in direct contact with the entire upper side of the upper inner flange 64 of the uppermost tube element 106 and that the third portion has an inner peripheral face 75 tapering downward.

Figure 16:
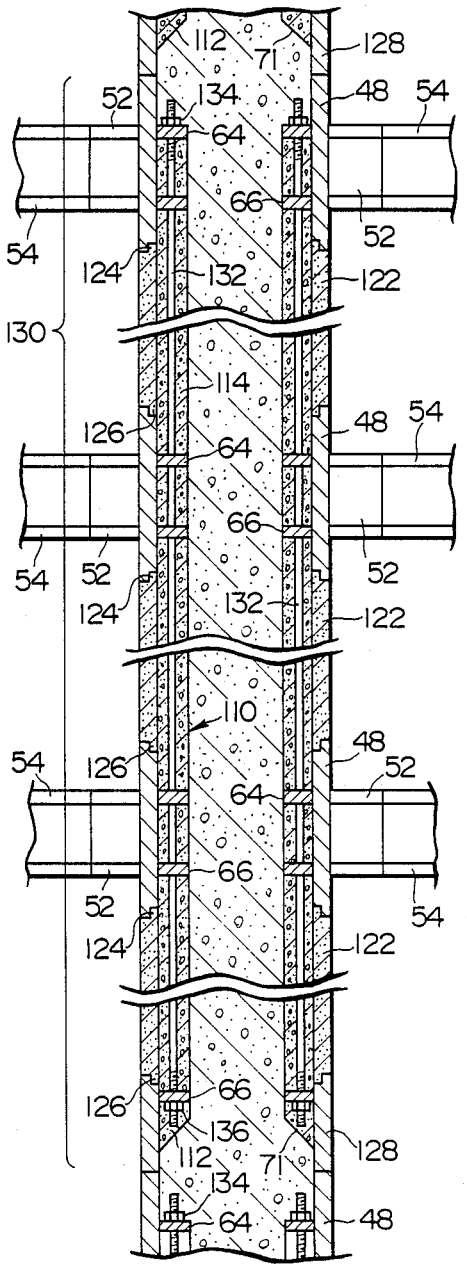
FIG. 16 is a fragmentary axial-sectional view of a modified form of the column in FIG. 13.

FIG. 16 illustrates a modified form of the concrete filled tube column in FIG. 13, in which each of tube element bodies 122 is made of the aforementioned carbon fiber reinforced concrete. Each tube piece body 122 has upper and lower end portions 124 and 126 having smaller outer diameters than the outer diameter of its central portion. The upper end portion 124 of the tube piece body 122 concentrically fits in the upper adjoining joint tube 48, while the lower end portion 126 of the tube piece body 122 coaxially fits in the lower adjoining joint tube 48. A cylindrical connecting member 128 having an inner flange 66 is coaxially engaged with the lower end of the lowermost tube element body 122 of each tube piece 130, and is welded at its lower end to the uppermost joint tube 48 of the lower adjoining tube piece 130. The uppermost joint tube 48 and the connecting member 128 of the tube piece 130 are fastened to each other by a plurality of axially extending reinforcing bars 132 circumferentially disposed at angular intervals about the axis the tube piece 130, whereby between the uppermost joint tube 48 and the connecting member 128, the other joint tubes 48 and the tube element bodies 122 are fixedly sandwiched. Each of the reinforcing bars 132 has upper and lower threaded end portions and passes through all the inner flanges 64 and 66 of the tube piece 130. The upper threaded end portion of each reinforcing bar 132 projects upward from the upper inner flange 64 of the uppermost joint tube 48 and is secured to the upper side of the upper inner flange 64 by a nut 134. On the other hand, the lower threaded end portion o each reinforcing bar 132 projects downward from the inner flange 66 of the connecting member 128 and is secured to the lower side of the inner flange 66 by a nut 136. A first portion 112 of the concrete layer 110 is formed under the inner flange 66 of the connecting member 128, while a second portion 114 of the concrete layer 110 is formed between the inner flange 66 of the connecting member 128 and the upper inner flange 64 of the uppermost joint tube 48. Neither a separating layer nor stress reducing means is disposed on each tube piece 130. To construct such a concrete filled tube column, a plurality of precast structural tubes 138 (see FIG. 17) are manufactured in a factory. Each precast structural tube 138 is manufactured almost in the same manner as the manner of manufacturing the precast tube 120 except that the joint tubes 48 and the tube element bodies 122 are alternately connected by using both the connecting member 128 and the reinforcing bars 132. The concrete layer 110 is formed by the centrifugal molding after the continuous tube piece 130 is formed, and thereby the reinforcing bars 132 and the nuts 134 and 136 are embedded in the concrete layer 110 when the precast structural tube 138 is completed.

In the foregoing embodiments, although the tube pieces have circular cross sections, tube pieces having polygonal cross sections may be employed in places of the round tube pieces. Also, instead of the high strength concrete, the same concrete as the concrete constituting the core 44 is used for forming the concrete layers. Furthermore, in place of the gap 82 or the grooves 118, a plurality of rows of through slots formed in the tube piece may be employed. Such through slots in a row are circumferentially disposed on the tube piece at angular intervals about the axis of the tube piece, and adjacent through slots of two adjacent rows are shifted in their positions in a zigzag manner.

What is claimed is:

1. A concrete filled tube column which constitutes a part of the framework of a structure, the concrete filled tube column comprising:

an outer tube connected to beams of the structure so that an axial load is transferred from the beams and applied to the outer tube, the outer tube consisting of a plurality of tube pieces coaxially disposed in series, the tube pieces having equal transverse inner sizes, each of the tube pieces having an inner face;

a concrete core disposed within the outer tube;

a first inner flange, peripherally mounted on the inner face of each of the tube pieces and projecting radially inward, for transferring the axial load from the outer tube to the concrete core, the first inner flange having upper and lower sides; and a concrete layer peripherally disposed on the inner face of each of the tube pieces, the concrete layer including a first tubular portion concentric with each of the tube pieces, the first tubular portion being positioned under the first inner flange in such a manner that the first tubular portion is in direct contact with the entire lower side of the first inner flange, the first tubular portion having a first inner peripheral face tapering upward so that the transverse inner size at the lower end of the first tubular portion is equal to the transverse inner size of each of the tube pieces.

2. A concrete filled tube column according to claim 1, wherein each of the tube pieces has upper and lower sections, and wherein the first inner flange and the concrete layer are disposed within the upper section of each of the tube pieces.

3. A concrete filled tube column according to claim 2, further comprising: a separating layer, interposed between the concrete core and the inner face of each of the tube pieces, for separating the core from the inner face of each of the tube pieces so that each of the tube pieces is not bonded to the core; and axial stress reducing means, disposed on the outer tube and including an annular portion peripherally extending completely around the outer tube, for reducing an axial stress which develops in the outer tube when the axial load is applied to the outer tube, each of the tube pieces being made of steel, the lower section of each of the tube pieces being connected to the beams of the structure.

4. A concrete filled tube column according to claim 3, wherein the tube pieces are spaced apart from one another so that ring-shaped gaps, having axial widths, are formed among the tube pieces, and wherein the stress reducing means comprises the gaps, the gaps varying their widths when the outer tube is subjected to the axial load whereby the axial stress in the outer tube is reduced.

5. A concrete filled tube column according to claim 2, wherein the upper section of each of the tube pieces comprises a joint tube made of steel, the joint tube having a lower end and being connected to the beams of the structure, and wherein the lower section of each of the tube pieces comprises a tube piece body coaxially joined to the lower end of the joint tube.

6. A concrete filled tube column according to claim 5, wherein the concrete layer further includes a second tubular portion concentric with each of the tube pieces, the second tubular portion being positioned above the first inner flange in such a manner that the second tubular portion is in direct contact with the entire upper side of the first inner flange, the second tubular portion having a second inner peripheral face tapering downward so that the transverse inner size at the upper end of the second tubular portion is equal to the transverse inner size of each of the tube pieces.

7. A concrete filled tube column according to claim 5, further comprising a second inner flange mounted on the inner face of the joint tube and projecting radially inward, the second inner flange having upper and lower sides and being positioned above the first inner flange so that the lower side of the second inner flange confronts the upper side of the first inner flange, wherein the joint tube has a plurality of bracket members, each being made of H-steel bar and projecting radially outward from the outer face of the joint tube, the joint tube being connected to the beams of the structure through the bracket members, each of the bracket members including: upper and lower flange portions, the upper flange portion being positioned at the same level as the second inner flange, the lower flange portion being positioned at the same level as the first inner flange; and a web portion joining the flange portions, and wherein the concrete layer further includes a second tubular portion coaxial with each of the tube pieces and extending between the first and second inner flanges, the second tubular portion having a transverse inner size not larger than the transverse inner sizes of the first and second inner flanges.

8. A concrete filled tube column according to claim 7, wherein the concrete layer further includes a third tubular portion concentric with each of the tube pieces, the third tubular portion being positioned above the second inner flange in such a manner that the third tubular portion is in direct contact with the entire upper side of the second inner flange, the third tubular portion having a second inner peripheral face tapering downward so that the transverse inner size at the upper end of the third tubular portion is equal to the transverse inner size of each of the tube pieces.

9. A concrete filled tube column according to claim 5, 6, 7 or 8, wherein the tube piece body is made of a carbon fiber reinforced concrete.

10. A concrete filled tube column according to claim 5, 6, 7 or 8, further comprising: a separating layer, interposed between the concrete core and the inner face of each of the tube pieces, for separating the core from the inner face of each of the tube pieces so that each of the tube pieces is not bonded to the core; and axial stress reducing means, disposed on the outer tube and including an annular portion peripherally extending completely around the outer tube, for reducing an axial stress which develops in the outer tube when the axial load is applied to the outer tube, and wherein the tube piece body is made of steel.

11. A concrete filled tube column according to claim 1, wherein each of the tube pieces comprises a plurality of tube elements coaxially joined in series, each of the tube elements being connected to the beams of the structure, wherein the first inner flange is mounted on the inner face of the lowermost tube element, wherein each of the tube elements except for the lowermost tube element has a radially inwardly projecting second inner flange peripherally mounted on the inner face thereof, and wherein the concrete layer further includes a second tubular portion concentric with each of the tube elements and extending between the first inner flange and second inner flange of the uppermost tube element, the second tubular portion having a transverse inner size not larger than the transverse inner sizes of the first and second inner flanges.

12. A concrete filled tube column according to claim 11, wherein the second inner flange has upper and lower sides, wherein the concrete layer further includes a third tubular portion concentric with each of the tube elements, the third tubular portion being positioned above the second inner flange of the uppermost tube element in such a manner that the third tubular portion is in direct contact with the entire upper side of the second inner flange, the third tubular portion having a second inner peripheral face tapering downward so that the transverse inner size at the upper end of the third tubular portion is equal to the transverse inner size of each of the tube pieces.

13. A concrete filled tube column according to claim 12, wherein the uppermost tube element has an upper end portion, wherein the lowermost tube element has a lower end portion, and wherein the concrete layer is disposed within that portion of each of the tube pieces excluding the upper and lower end portions of respective uppermost and lowermost tube elements.

14. A concrete filled tube column according to claim 11, 12 or 13, further comprising: a separating layer, interposed between the concrete layer and inner face of each of the tube pieces and between the concrete core and the inner face of each of the tube pieces, for separating the inner face of each of the tube pieces from both the concrete layer and the concrete core so that each of the tube pieces is not bonded to either the concrete layer or the concrete core; and axial stress reducing means, disposed on the outer tube and including an annular portion peripherally extending completely around the outer tube, for reducing an axial stress which develops in the outer tube when the axial load is applied to the outer tube, and wherein each of the tube elements is made of steel.

15. A precast structural tube for use in a column part of the framework of a structure, the precast structural tube comprising:

a tube piece having an inner face and first and second ends;

a first inner flange mounted on the inner face of the tube piece and projecting radially inward, the first inner flange having first and second sides, the first side being closer to the first end of the tube piece than the second side;

a concrete layer peripherally disposed on the inner face of the tube piece, the concrete layer including a first tubular portion concentric with the tube piece, the first tubular portion having opposite ends and a first inner peripheral face, one of the opposite ends of the first tubular portion being in direct contact with the entire first side of the first inner flange, the first inner peripheral face of the first tubular portion tapering toward the second end of the tube piece so that the transverse inner size at the other end of the first tubular portion is equal to the transverse inner size of the tube pieces.

16. A precast structural tube according to claim 15, wherein the first inner flange and the concrete layer are positioned at the second end section of the tube piece.

17. A precast structural tube according to claim 16, wherein the second end section of the tube piece comprises a steel joint tube having bracket members, each of the bracket members projecting radially outward from the outer face of the joint tube, and wherein the remainder of the tube piece comprising a steel tube piece body coaxially joined to the joint tube.

18. A precast structural tube according to claim 17, wherein the concrete layer further includes a second tubular portion concentric with the tube piece, the second tubular portion having opposite ends and a second inner peripheral face, one of the opposite ends of the second tubular portion being in direct contact with the entire second side of the first inner flange, the second inner peripheral face of the second tubular portion tapering toward the first end of the tube piece so that the transverse inner size at the other end of the second tubular portion is equal to the transverse inner size of the tube pieces.

19. A precast structural tube according to claim 17, further comprising a second inner flange mounted on the inner face of the joint tube and projecting radially inward, the second inner flange being positioned closer to the second end of the tube piece than the first inner flange, the second inner flange having first and second sides, the first side of the second inner flange confronting the second side of the first inner flange, wherein each of the bracket members is made of H-steel bar and includes: first and second flange portions, the first flange portion being positioned at the same level as the first inner flange, the second flange portion being positioned at the same level as the second inner flange; and a web portion joining the first and second flange portions, and wherein the concrete layer further includes a second tubular portion coaxial with the tube piece and extending between the first and second inner flanges, the second tubular portion having a transverse inner size not larger than the transverse inner sizes of the first and second inner flanges.

20. A precast structural tube according to claim 19, wherein the concrete layer further includes a third tubular portion concentric with the tube piece, the third tubular portion having opposite ends and a second inner peripheral face, one of the opposite ends of the third tubular portion being in direct contact with the entire second side of the second inner flange, the second inner peripheral face of the third tubular portion tapering toward the first end of the tube piece so that the transverse inner size at the other end of the third tubular portion is equal to the transverse inner size of the tube pieces.

21. A precast structural tube according to claim 16, 17, 18, 19 or 20, further comprising a separating layer applied to the inner face of the tube piece body, the separating layer separating the inner face of the tube piece body from a concrete, which is to be charged into the tube piece, so that the tube piece body is not bonded to the concrete.

22. A precast structural tube according to claim 21, further comprising stress reducing means, disposed on the tube piece and including an annular portion peripherally extending completely around the tube piece, for reducing an axial stress which develops in the tube piece when an axial load is applied to the tube piece.

23. A precast structural tube according to claim 15, wherein the tube piece comprises a plurality of tube elements coaxially joined in series, each of the tube elements having bracket members projecting radially outward from the outer face of the tube piece, wherein the first inner flange is mounted on the inner face of the tube element at the first end of the tube piece, wherein each of the tube elements except for the element at the first end of the tube piece has a radially inwardly projecting second inner flange peripherally mounted on the inner face thereof, and wherein the concrete layer further includes a second tubular portion concentric with the tube piece and extending between the first inner flange and second inner flange of the tube element at the second end of the tube piece, the second tubular portion having a transverse inner size not larger than the transverse inner size of the first and second inner flanges.

24. A precast structural tube according to claim 23, wherein the second inner flange has first and second sides, first side being closer to the first end of the tube piece than the second side, wherein the concrete layer further includes a third tubular portion concentric with the tube piece, the third tubular portion having opposite ends and a second inner peripheral face, one of the opposite ends of the third tubular portion being in direct contact with the entire second side of the second inner flange at the second end of the tube piece, the second inner peripheral face of the third tubular portion tapering toward the first end of the tube piece so that the transverse inner size at the other end of the third tubular portion is equal to the transverse inner size of the tube pieces.

25. A precast structural tube according to claim 24, wherein the tube element at the first end of the tube piece and the tube element at the second end of the tube piece have respective free end portions, and wherein the concrete layer is disposed within that portion of the tube piece excluding the free end portions of the tube elements at the first and second end of the tube piece.

26. A precast structural tube according to claim 23, 24, or 25, further comprising: a separating layer applied to that portion of the inner face of the tube piece on which the inner flange is not mounted, the separating layer separating the inner face of the tube piece from the concrete layer so that the concrete layer is not bonded to the tube piece; and stress reducing means, disposed on the tube piece and including an annular portion peripherally extending completely around the tube piece, for reducing an axial stress which develops in the tube piece when an axial load is applied to the tube piece.

27. A precast structural tube according to claim 23, 24 or 25, wherein each of the tube element comprises: a joint tube made of steel; and a tube element body made of carbon fiber reinforced concrete and coaxially connected to the joint tube, both the bracket member and the inner flange being welded to the joint tube of each of the tube element.

28. A method of constructing a concrete filled tube column which constitutes a part of the framework of a structure, the method comprising the steps:

(a) preparing a plurality of precast structural tubes, each including: a tube piece having an inner face and first and second ends; a first inner flange mounted on the inner face of the tube piece and projecting radially inward, the first inner flange having first and second sides, the first side being closer to the first end of the tube piece than the second side; and a concrete layer peripherally disposed on the inner face of the tube piece, the concrete layer including a first tubular portion concentric with the tube piece, the first tubular portion having opposite ends and a first inner peripheral face, one of the opposite ends of the first tubular portion being in direct contact with the entire first side of the first inner flange, the first inner peripheral face of the first tubular portion tapering toward the second end of the tube piece so that the transverse inner size at the other end of the first tubular portion is equal to the transverse inner size of the tube pieces;

(b) erecting one of the prepared precast structural tube with the second end of the tube piece positioned above the first end thereof;

(c) placing concrete within the erected precast structural tube to form a concrete core within the structural tube;

(d) joining the beams of the structure to the erected precast structural tube;

(e) coaxially connecting another precast structural tube to the upper end of the erected precast structural tube, whereby said another structural tube is erected on the lower adjoining structural tube; and (f) after steps (c) to (e), repeating steps (c) to (f).

29. A method according to claim 28, wherein step (a) comprises the steps:

(g) preparing the tube piece (h) mounting the first inner flange on the inner face of the tube piece;

(i) mounting bracket members to the tube piece so that the bracket members project radially outward from the outer face of the tube piece; and (j) after steps (h) and (i), forming the concrete layer on the inner face of the tube piece, and wherein step (d) comprises the step:

(k) joining the beams of the structure to the bracket members.

30. A method according to claim 29, wherein step (g) comprises the steps:

(1) preparing a steel joint tube;

(m) preparing a tube piece body; and (n) coaxially joining the joint tube to the tube piece body to form the tube piece, wherein step (h) comprises the step:

(o) welding the first inner flange to the inner face of the joint tube, and wherein step (i) comprises the step:

(p) welding the bracket members to the outer face of the joint tube.

31. A method according to claim 30, wherein step (j) comprises the step:

(q) forming a second tubular portion of the concrete layer, the second tubular portion being concentric with the tube piece, the second tubular portion having opposite ends and a second inner peripheral face, one of the opposite ends of the second tubular portion being in direct contact with the entire second side of the first inner flange, the second inner peripheral face of the second tubular portion tapering toward the first end of the tube piece so that the transverse inner size at the other end of the second tubular portion is equal to the transverse inner size of the tube pieces.

32. A method according to claim 29, wherein step (g) comprises the steps:

(r) preparing a plurality of steel tube elements;

(s) coaxially joining the tube elements in series to form the tube piece; wherein step (h) comprises the step:

(t) welding the first inner flange to the inner face of the tube element at the first end of the tube piece, wherein step (a) further comprises the step:

(u) before step (j), welding a second inner flange to the inner face of each of the tube elements except for the tube element at the first end of the tube piece so that the second inner flange projects radially inward from the inner face of each of the tube elements, wherein step (i) comprises the step:

(v) welding the bracket members to the outer face of each of the tube elements, and wherein step (j) comprises the step:

(w) after step (s), forming a second tubular portion of the concrete layer, the second tubular portion being concentric with the tube piece and extending between the first inner flange and the second inner flange welded to the tube element at the second end of the tube piece, the second tubular portion having a transverse inner size not larger than the transverse inner size of the tube piece.

33. A method according to claim 29 or 30, wherein step (j) comprising the steps:

(x) rotating the tube piece about the axis thereof; and (y) charging concrete into the tube piece, whereby the concrete is subjected to a centrifugal force due to the rotation of the tube piece, resulting in formation of the concrete layer spread on the inner face of the tube piece.

* * * * *

UNITED STATES PATENT AND TRADEMARK OFFICE

CERTIFICATE OF CORRECTION

PATENT NO. : 4,864,797

DATED : September 12, 1989

INVENTOR(S) : Takanori Sato, et al.

It is certified that error appears in the above-identified patent and that said Letters Patent is hereby corrected as shown below:

Column 2, line 49: "r" should read as --or--

Column 3, line 29: "FIG" should read as --FIG 4;--

Column 3, line 49: "3" should read as --13--

Column 4, line 39: "01" should read as --$\theta_1$--

Column 4, line 55: "02" should read as --$\theta_2$--

Column 7, line 29: "an" should read as --and--

Column 7, line 48: "filed" should read as --filled--

Column 9, line 60: "o" should read as --of--

Signed and Sealed this

Fifteenth Day of January, 1991

*Attest:*

HARRY F. MANBECK, JR.

*Attesting Officer*

*Commissioner of Patents and Trademarks*